US012702243B2

(12) United States Patent
Fogg

(10) Patent No.: US 12,702,243 B2
(45) Date of Patent: Aug. 11, 2026

(54) GARMENT STRETCHING APPARATUS

(71) Applicant: Justina Paige Fogg, Springdale, AZ (US)

(72) Inventor: Justina Paige Fogg, Springdale, AZ (US)

( * ) Notice: Subject to any disclaimer, the term of this patent is extended or adjusted under 35 U.S.C. 154(b) by 0 days.

(21) Appl. No.: 15/905,805

(22) Filed: Feb. 26, 2018

(65) Prior Publication Data

US 2018/0249854 A1 Sep. 6, 2018

Related U.S. Application Data

(63) Continuation-in-part of application No. 15/331,741, filed on Oct. 21, 2016, now Pat. No. 9,901,205.

(51) Int. Cl.

| | |
|---|---|
| ***D06C 15/00*** | (2006.01) |
| ***A47G 25/62*** | (2006.01) |
| ***A47G 25/68*** | (2006.01) |

(52) U.S. Cl.

CPC ..... *A47G 25/62* (2013.01); *A47G 25/68* (2013.01)

(58) Field of Classification Search

CPC .... A47G 25/62; A47G 25/621–25/629; A47G 25/66; A47G 25/68; A47G 25/70; A47G 25/76

See application file for complete search history.

(56) References Cited

U.S. PATENT DOCUMENTS

| | | | | | |
|---|---|---|---|---|---|
| 1,390,054 | A * | 9/1921 | McNeely | A47G 25/62 | 38/102.4 |
| 1,579,385 | A * | 4/1926 | Nelson | A47G 25/62 | 38/102.4 |
| 1,856,064 | A * | 5/1932 | Alexander | A47G 25/62 | 38/102.4 |
| 3,790,043 | A * | 2/1974 | Hagen | A47G 25/62 | 223/61 |
| 4,846,430 | A * | 7/1989 | Ke | A47G 25/00 | 211/119.004 |
| 5,595,331 | A * | 1/1997 | Leistner | A47G 25/483 | 223/91 |
| 6,158,593 | A * | 12/2000 | Olsen | A63B 47/00 | 211/14 |
| 6,223,910 | B1 * | 5/2001 | Levin | A47F 7/06 | 211/113 |
| 7,810,654 | B1 * | 10/2010 | Wang | A47G 25/06 | 211/106.01 |
| 2005/0109802 | A1 * | 5/2005 | Avery | A47F 5/0006 | 223/85 |
| 2009/0188954 | A1 * | 7/2009 | Mangano | A47G 25/62 | 223/93 |
| 2010/0181351 | A1 * | 7/2010 | Kirschbaum | A47G 25/0657 | 223/96 |
| 2014/0027597 | A1 * | 1/2014 | Farris | F16B 7/105 | 248/339 |

* cited by examiner

*Primary Examiner* — Nathan Durham
(74) *Attorney, Agent, or Firm* — Incorporating Innovation LLC; Charlena Thorpe, Esq.

(57) ABSTRACT

Implementations of a garment stretching apparatus are provided. In some implementations, the garment stretching apparatus comprises a top attachment device, a bottom attachment device, an adjustable strap, a first hanger, and a second hanger. The adjustable strap adjusts the height of the garment stretching apparatus to fit any door and also adjust the garment stretching apparatus to a desired stretching.

6 Claims, 9 Drawing Sheets

FIG. 7
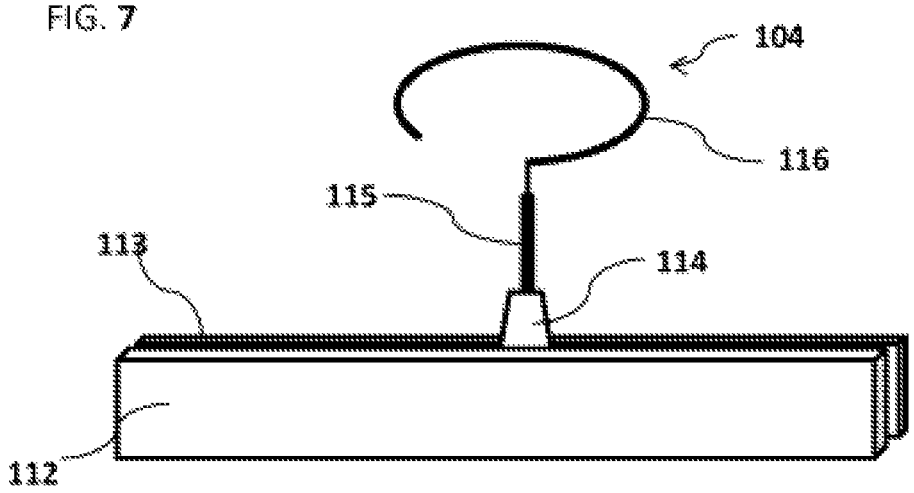
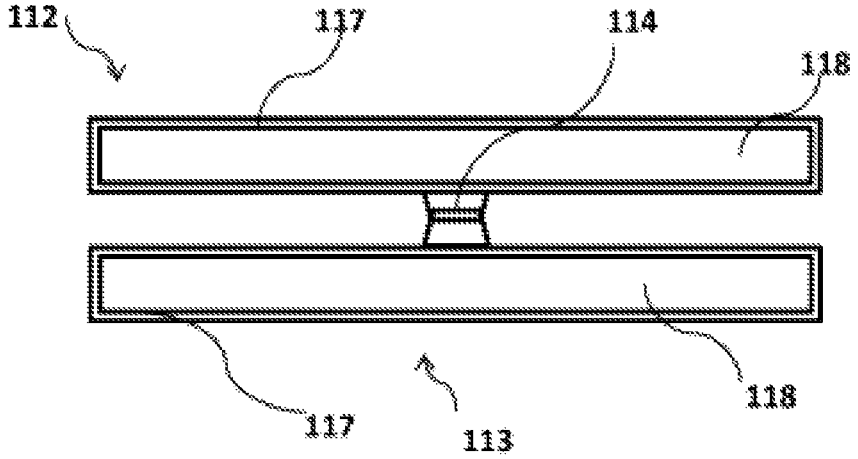
FIG. 8

GARMENT STRETCHING APPARATUS

CROSS REFERENCE TO RELATED APPLICATION

This continuation in part application claims the benefit of U.S. patent application Ser. No. 15/331,741, filed on Oct. 21, 2016, which is a continuation-in-part of U.S. patent application Ser. No. 15/076,637, filed on Mar. 21, 2016, which is a continuation of U.S. patent application Ser. No. 14/319,120, filed on Jun. 30, 2014 (now U.S. Pat. No. 9,290,875). All of the aforementioned applications are incorporated herein by reference in their entirety.

TECHNICAL FIELD

This disclosure relates to implementations of a garment stretching apparatus.

BACKGROUND

There are a number of existing garment stretching apparatus that are designed to stretch various articles of clothing. Generally, these existing garment stretching apparatus focus on a specific article of clothing, such as shirts or blouses, or focus on a specific aspect of a clothing article such as a shirt collar or a waist band of a skirt. Typically, these existing garment stretching apparatus comprise several sections that are mechanically adjusted to achieve a pre-set stretching amount. Furthermore, these existing garment stretching apparatus typically are overly complicated and not user friendly.

BRIEF DESCRIPTION OF THE DRAWINGS

FIGS. 1-8 illustrate a first implementation of an example garment stretching apparatus according the present disclosure.

DETAILED DESCRIPTION

Implementations of a garment stretching apparatus are provided. In some implementations, the garment stretching apparatus comprises a top attachment device, a bottom attachment device, an adjustable strap, a first hanger, and a second hanger. The adjustable strap adjust the height of the garment stretching apparatus to fit any door and also adjust the garment stretching apparatus to a desired stretching.

Figure 1:
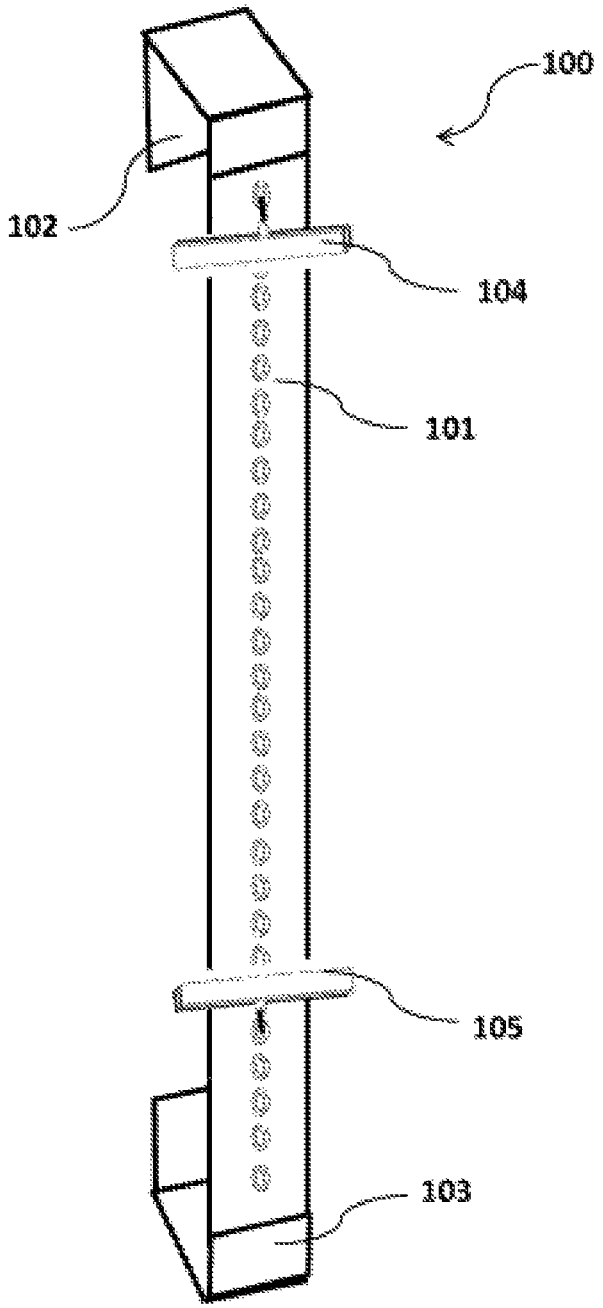
Figure 2:
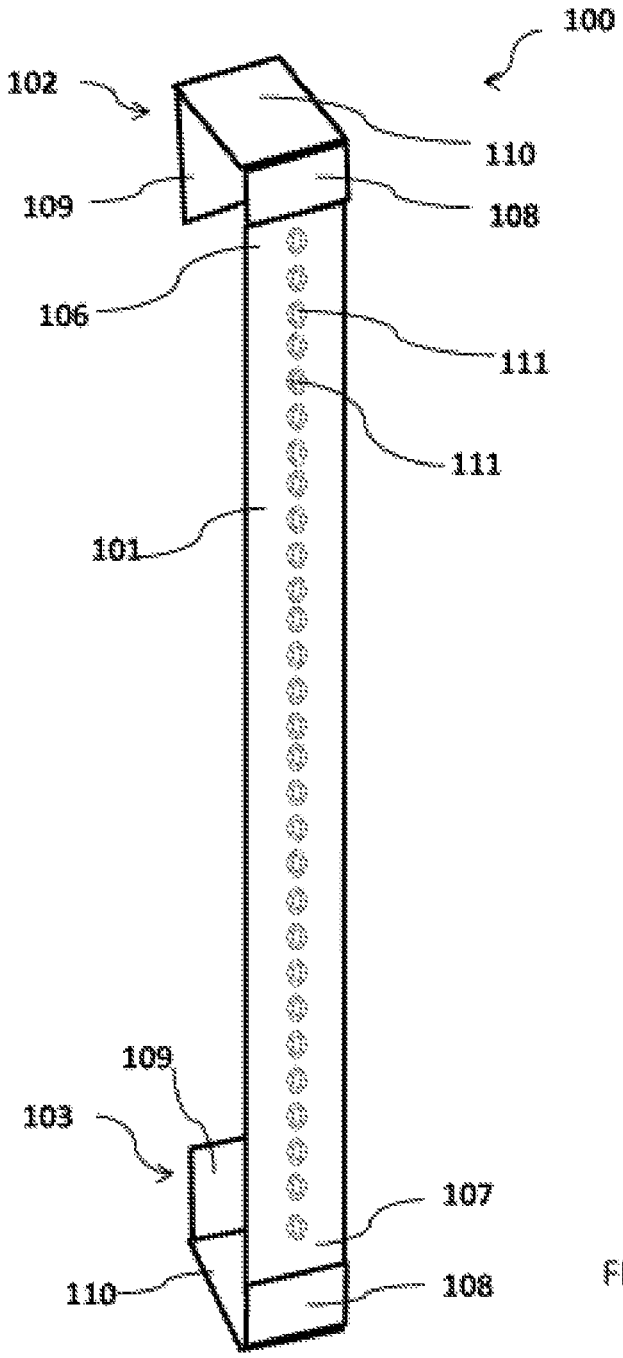
Figure 3:
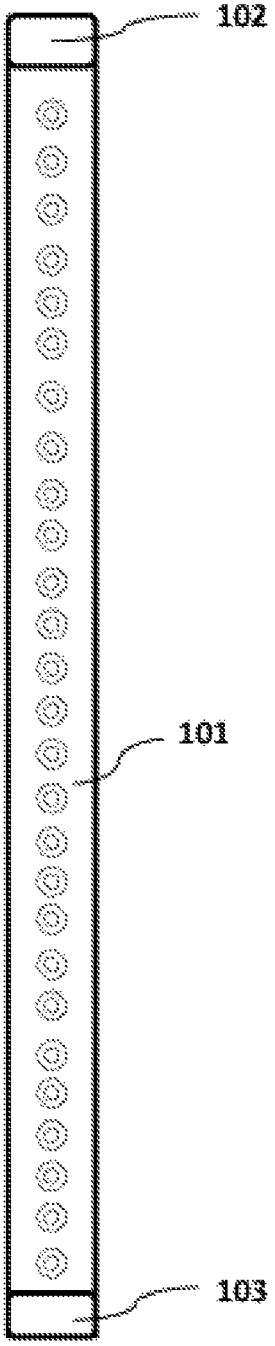
Figure 4:
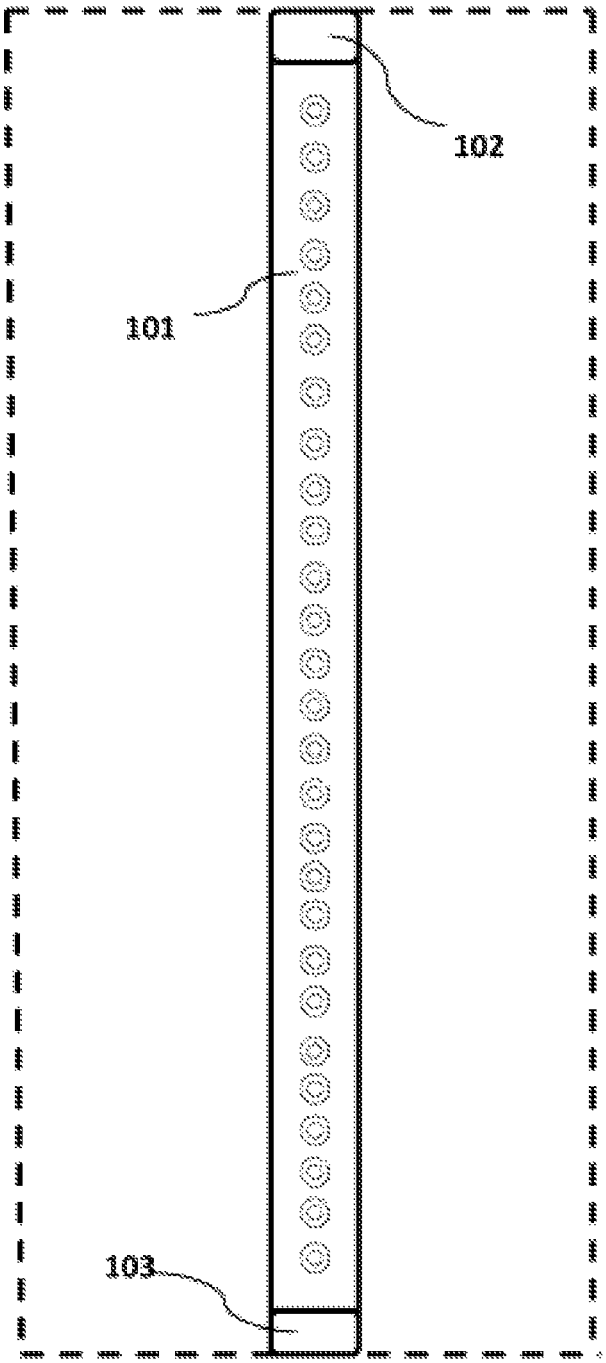

FIGS. 1-8 illustrate a first implementation of an example garment stretching apparatus 100 according the present disclosure. In some implementations, as shown in FIG. 1, the garment stretching apparatus 100 comprises a strap 101, a top bracket 102, a bottom bracket 103, and a pair of clamps, 104, 105. In some implementations, as shown in FIGS. 1-4, the strap 101 may comprise a plurality of apertures 111 extending through the strap. In some implementations, the apertures may include grommets. In some implementations, the apertures 111 extend down the strap (e.g., along the horizontal center of the strap). In some implementations, the apertures 111 are spaced evenly along the strap.

Figure 6:
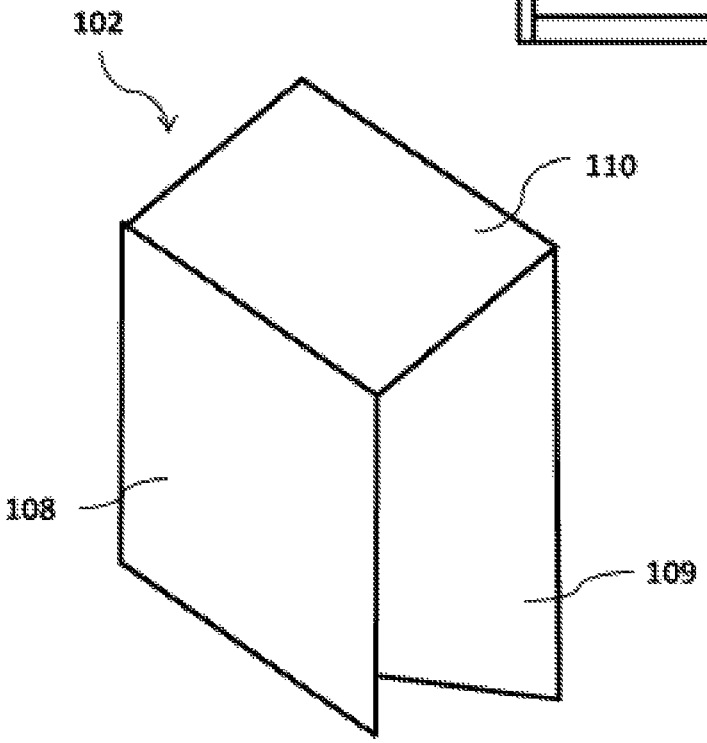

As shown in FIG. 6, the top bracket 102 may be U shaped or generally U-shaped and configured to fit on the top of and around the edges of an elongated horizontal surface, such as a the top of a door. In some implementations, the top bracket 102 is connected on a first end 106 of the strap 101.

Figure 5:
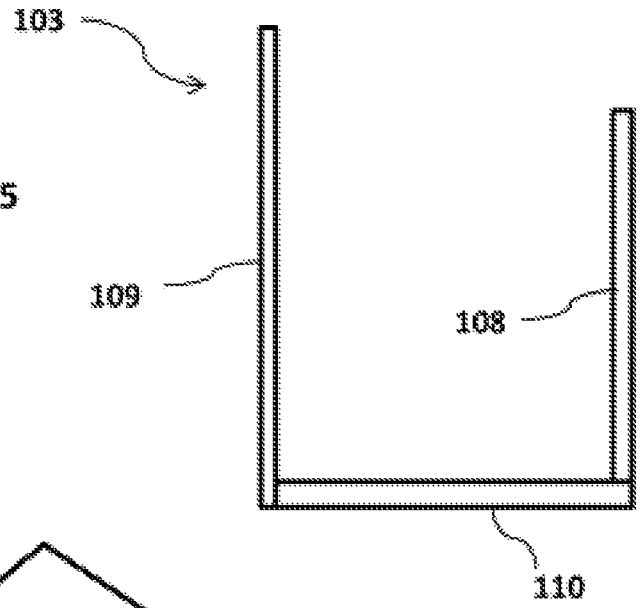

Similarly, as shown in FIG. 5, the bottom bracket 103 may be U shaped or generally U-shaped and configured to fit under and around the edges of an elongated horizontal surface, such as the bottom of a door. In some implementations, the bottom bracket 103 is connected on a second end 107 of the strap 101.

In some implementations, the top bracket 102 comprises a first side 108, a second side 109, and a third side 110 extending from the first side 108 to the second side 109 thereby forming a u-shaped gap.

Similarly, in some implementations, the bottom bracket 103 comprises a first side 108, a second side 109, and a third side 110 extending from the first side 108 to the second side 109 thereby forming a u-shaped gap.

In some implementations, the third side 110 of the top bracket 102 is configured to rest on top of a horizontal surface and the first side and second side of the top bracket 102 are configured to extend downwardly on both sides, respectively, of the horizontal surface. Similarly, the third side 110 of the bottom bracket 103 is configured to rest against a horizontal surface and the first side and second side of the bottom bracket 103 are configured to extend upwardly on both sides, respectively, of the horizontal surface.

In some implementations, the strap 101 may be made of nylon materials.

In some implementations, the brackets 102, 103 may be made from plastic, metal, or any other suitable material.

In some implementations, as shown in FIGS. 7 and 8, each clamp 104, 105 comprises a hook 116 and a pair of flats 112, 113 configured to hold a portion of a garment. In some implementations, an inner side 117 of each flat 112, 113 may be lined with a strip of material 118 for added grip. The strip of material 118 may be fastened to the inner side 117 of each flat 112, 113 by adhesive or other similar materials.

In some implementations, each clamp 104, 105 may further comprise a clamp mechanism 114. In some implementations, when the clamp mechanism 114 is folded downward, the flats 112, 113 may open to enable the user in place a portion of a garment between the flats, 112, 113.

In some implementations, each clamp 104, 105 may further comprise an elastic device 115.

To stretch a garment using the garment stretching apparatus 100 according to present disclosure, the top bracket 102 is placed on top of a door where the third side of the top bracket rests on top of the door and a portion of the door is positioned in the u-shape gap of the top bracket.

The bottom bracket 103 is placed under a bottom of a door where the third side of the bottom bracket 103 rest under the bottom of the door and a portion of the door is positioned in the u-shape gap of the second bracket. In this way, the strap 101 extends vertically from the top bracket to the bottom bracket.

A first portion of a garment is secured between the pair of flats of the top clamp 104 and the hook is attached to the garment stretching apparatus 100 at a first position such that the hook of the top clamp 104 is above the pair of flats of the top clamp 104. In some implementations, the hook of the top clamp 104 is attached to the garment stretching apparatus by inserting the hook 116 of the top clamp 104 into an aperture 111 of the strap 101.

A second portion of the garment is secured between the pair of flats of the bottom clamp 105 and the hook is attached to the garment stretching apparatus 100 at a second position lower than the first position on the garment stretching apparatus 100. In some implementations, the hook of the bottom clamp 105 is attached to the garment stretching apparatus by inserting the hook 116 of the bottom clamp 105 into an aperture 111 of the strap 101. The user may select a lower aperture to insert the hook of the bottom clamp 105 based on the amount of stretching desired. The bottom clamp is positioned such that the hook of the bottom clamp 105 is below the second pair of flats (i.e., the bottom clamp is upside-down) thereby allowing the garment attached to the top clamp 104 and the bottom clamp 105 extends vertically from the pair of flats of the top clamp 104 to the pair of flats of the bottom clamp 105.

Figure 9:
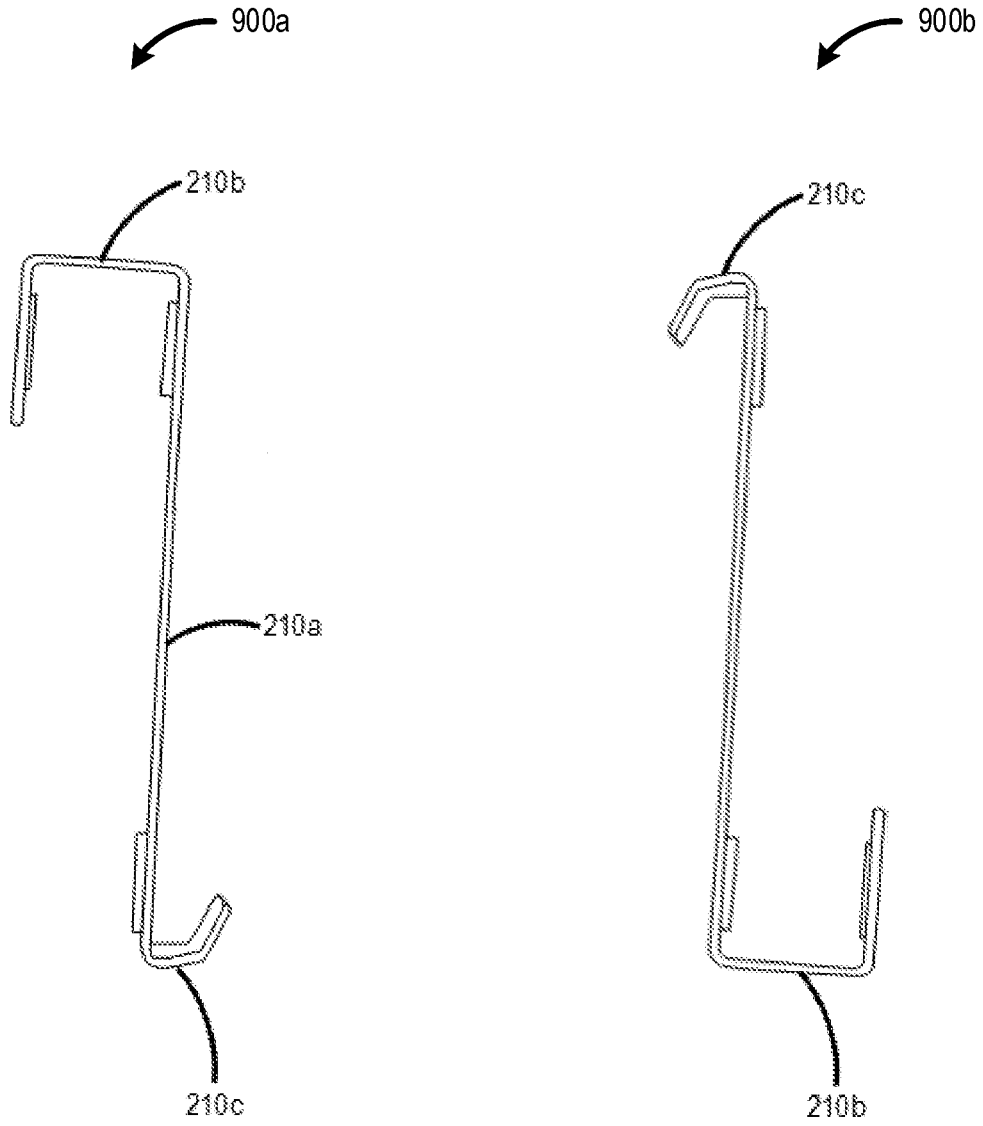
FIGS. 9-10 illustrate a second implementation of an example garment stretching apparatus according the present disclosure.
Figure 10:
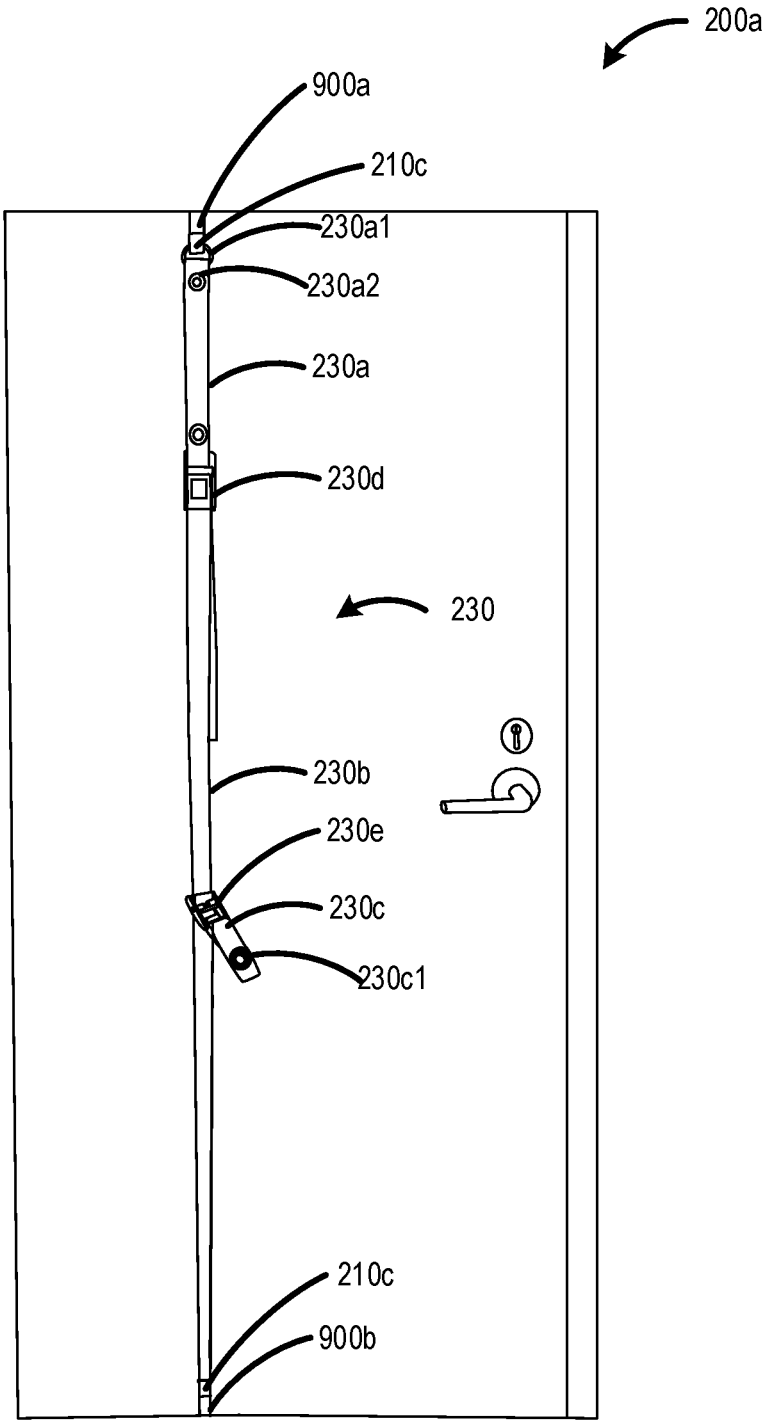

FIGS. 9-10 illustrate a second implementation of an example garment stretching apparatus 200*a* according the present disclosure. FIG. 9 is a side view of attachment devices 900*a*, 900*b* of the garment stretching apparatus 200*a*. In some implementation, the attachment devices 900*a*, 900*b* may have a similar construction (e.g., just a rotated and/or flipped version of the other) and any deviations in the construction may be the result of manufacturing tolerances. In some implementation, the attachment device 900*a* can be a top attachment device and attachment device 900*b* may be a bottom attachment device as discussed below.

In some implementations, the garment stretching apparatus 200*a* comprises a top attachment device 900*a*, a bottom attachment device 900*b*, an adjustable strap 230, a first hanger 240, and a second hanger 250.

In some implementations, the top attachment device 900*a* is configured to rest on top of a door. In some implementations, as shown in FIG. 9, the top attachment device 900*a* comprises an elongated portion 210*a* having a first end and a second end, a first hook portion 210*b* extending from the first end, and a second hook portion 210*c* extending from the second end.

In some implementations, the first hook portion 210*b* forms a first hook on a first side of the elongated portion 210*a* and the second hook portion 210*c* forms a second hook on a second, opposite side of the elongated portion 210.

In some implementation, the first hook is configured such that a portion of the first hook rest on top of a horizontal surface and the sides of the hook are configured to extend downwardly on both sides, respectively, of the horizontal surface.

Similarly, in some implementations, the bottom attachment device 900*b* is configured to rest below a door. In some implementations, as shown in FIG. 9, the bottom attachment device 900*c* comprises an elongated portion 210*a* having a first end and a second end, a first hook portion 210*b* extending from the second end, and a second hook portion 210*c* extending from the first end.

In some implementations, the first hook portion 210*b* of the bottom attachment device 900*b* forms a first hook on a first side of the elongated portion 210*a* of the bottom attachment device 900*b* and the second hook portion 210*c* of the bottom attachment device 900*b* forms a second hook on a second, opposite side of the elongated portion 210 of the bottom attachment device 900*b*.

In some implementation, the first hook portion 210*b* of the bottom attachment device 900*b* is configured such that a portion of the first hook rest beneath a horizontal surface and the sides of the first hook portion of the bottom attachment device 900*b* are configured to extend upwardly on both sides, respectively, of the horizontal surface.

In some implementations, first hook portion 210*b* of the bottom attachment device 900*b* concaves upwardly and the second hook portion 210*c* concaves downwardly when the elongated portion 210*a* extends vertically.

In some implementation the adjustable strap 230 comprises a plurality of straps and buckles (e.g., cam buckles).

In some implementations, the adjustable strap 230 comprises a first strap 230*a* having a first end and a second end, a second strap 230*b* having a first end and a second end, and a third strap 230*c* having a first end and a second end.

In some implementations, the adjustable strap 230 further comprises at least a first buckle 230*d* and a second buckle 230*e*

In some implementations, a closed loop 230*a*1 (e.g., D-ring) may be attached to the first end of the first strap 230*a*. In some implementations, the closed loop is configured to receive the second hook 210*c* of the top attachment device 900*a*. Similarly, in some implementations, a closed loop (not shown) (e.g., D-ring) may be attached to the second end of the second strap 230*b*. In some implementations, the closed loop attached to the second end of the second strap 230*b* is configured to receive the second hook 210*c* of the bottom attachment device 900*b*.

In some implementations, the first strap 230*a* comprises one or more openings (e.g., opening 230*a*2) through the strap. In some implementations, the one or more openings extend along a portion of the first strap 230*a*. In some implementations, at least one of the openings is adjacent or near the first end of the first strap 230*a*.

In some implementations, the second end of the first strap 230*a* may be attached to a first side of the first buckle 230*d*.

In some implementations, the first end of the second strap 230*b* extends through the second side of the first buckle 230*d*.

In some implementations, the first strap 230*a*, the second strap 230*b*, and the first buckle 230*d* are configured such that the first buckle 230*d* adjusts the second strap 230*b* (that is, the first buckle 230*d* moves along the second strap 230*b*).

In some implementations, the second strap 230*b* extends through the first side of the second buckle 230*e*.

In some implementations, the third strap 230*c* is attached to the second side of the second buckle 230*e*. In some implementations, the third strap 230*c* comprises an opening 230*c*1 through the strap 230*c*.

In some implementations, the second strap 230*b*, the third strap 230*c*, and the second buckle 2303 are configured such that the second buckle 230*e* moves along the second strap 230*b*.

As discussed above, in some implementations, the second end of the second strap 230*b* is configured to receive the second hook 210*c* of the bottom attachment device 900*b*.

In some implementations, the adjustable strap 230 may be less than three straps or more than three straps. In some implementations, the adjustable strap 230 may comprise one buckle or more than two buckles.

Figure 11:
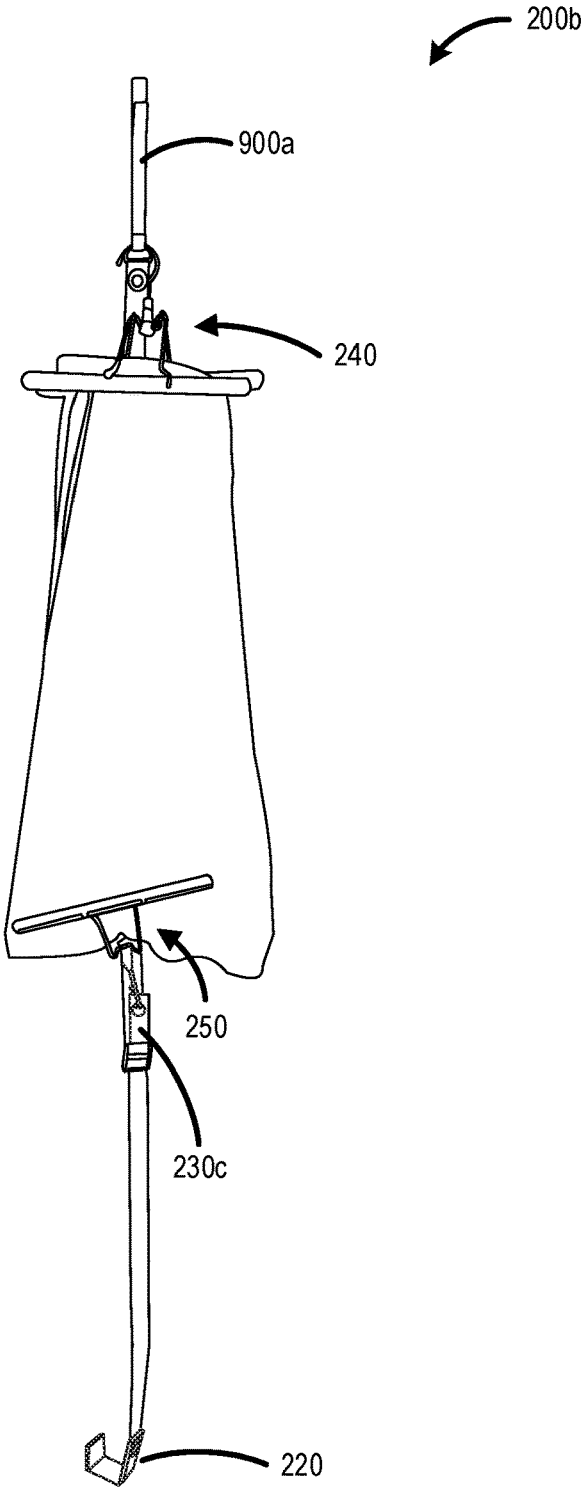
FIG. 11 illustrate a third implementation of an example garment stretching apparatus according the present disclosure.

As shown in FIG. 11, in some implementations, the bottom attachment device 220 may be similar to the bottom bracket 103. Thus, as shown in FIG. 11, in some implementations, the second end of the second strap 230*b* does not include a closed loop and attaches (e.g., via adhesive) to the bottom attachment device 220

In some implementations, clamps 104, 105 may be used with the garment stretching apparatus 200*a* of FIG. 10. In some implementations, the first hanger 240 and a second hanger 250 of the garment stretching apparatus 200*b* of FIG. 11 are similar to the clamps 104, 105. In some implementations, the garment stretching apparatus 200*a* of FIG. 10 is similar to the garment stretching apparatus 200*b* of FIG. 11 except for the bottom attachment device.

In some implementations, the clamps 104, 105 or hangers 240, 250 may be wooden. In some implementations, the inner side of one or more of the flats may be lined with a strip of the loop portion of hook and loop fastener (e.g., the loop portion of VELCRO).

To stretch a garment using the garment stretching apparatus 200*a*, 200*b*, the first hook 900*a* of the top attachment device 900*a* is placed on top of a door such that a portion of the first hook 210*b* rest on top of the door and the sides of the first hook are configured to extend downwardly on both sides, respectively, of the door.

The closed loop 230*a*1 of the first strap 230*a* is attached to the second hook 210*c* of the top attachment device 900*a*.

For the implementation of FIG. 10, the bottom attachment device 900*b* is placed under a bottom of the door such that a portion of the first hook 210*b* of the bottom attachment device 900*b* rest under the bottom of the door and the sides of the first hook are configured to extend upwardly on both, respectively, of the door. The closed loop on the second end of the second strap 230*b* is attached to the second hook 210*c* of the bottom attachment device 900*a*.

For the implementation of FIG. 11, the bottom attachment device 220 is placed under a bottom of the door where the third side of the bottom bracket 103 rest against the bottom of the door and a portion of the door is positioned in the u-shape gap of the bottom attachment device 210.

In this way, using either the implementation of FIG. 10 or FIG. 11, the adjustable strap 230 extends vertically from the top attachment device 900*a* to the bottom attachment device 900*b*, 220.

The first buckle 230*d* is used to adjust the second strap 230*b* thereby adjusting the height of the garment stretching apparatus 200. In some implementations, the second strap 230*b* is adjusted until the garment stretching apparatus 200*a*, 200*b* is tightly secured to the door.

As shown in FIG. 11 for either the implementation of FIG. 10 or FIG. 11, a first portion of a garment is secured between the pair of flats of the first hanger 240 and the hook is attached to the garment stretching apparatus 200*a*, 200*b* at a first position such that the hook of the first hanger 240 is above the pair of flats of the first hanger 240.

In some implementations, the hook of the first hanger 240 is attached to the garment stretching apparatus 200*a*, 200*b* by placing the hook of the first hanger 240 on the second hook of the top attachment device 210.

In some implementations, the hook of the first hanger 240 is attached to the garment stretching apparatus 200*a*, 200*b* by inserting the hook of the first hanger 240 into an opening of the strap 230 (e.g., an opening of the first strap 230*a*).

A second portion of the garment is secured between the pair of flats of the second hanger 250 and the hook of the second hanger 250 is attached to the garment stretching apparatus 200*a*, 200*b* at a second position lower than the first position on the garment stretching apparatus 200.

In some implementations, the hook of the second hanger 250 is attached to the garment stretching apparatus 200*a*, 200*b* by inserting the hook of the second hanger 250 into an opening 230*c*1 of the third strap 230.

The user may adjust the second buckle based on the amount of stretching desired.

The second hanger 250 is positioned such that the hook of the second hanger 250 is below the second pair of flats (i.e., the second hanger 250 is upside-down) thereby allowing the garment attached to the first hanger 240 and the second hanger 250 extend vertically from the pair of flats of the first hanger 240 to the pair of flats of the second hanger 250.

In some implementations, the closed loop of the first strap and/or second strap may be a D-ring. In some implementations, the closed loop may be any ring or loop structure of any shape or any structure having an opening therethrough. In some implementations, the closed loop may be manufactured from metal (e.g., steel, aluminum, and/or titanium). In some implementations, the closed loop may be manufactured from high strength plastic. In some implementations, the closed loop may be manufactured from any suitable material.

In some implementations, the straps 230*a, b, c* may be manufactured from tubular nylon webbing. In some implementations, the straps may be manufactured from flat nylon webbing. In some implementations, the straps may be manufactured from any material suitable.

Reference throughout this specification to "an embodiment" or "implementation" or words of similar import means that a particular described feature, structure, or characteristic is included in at least one embodiment of the present invention. Thus, the phrase "in some implementations" or a phrase of similar import in various places throughout this specification does not necessarily refer to the same embodiment.

Many modifications and other embodiments of the inventions set forth herein will come to mind to one skilled in the art to which these inventions pertain having the benefit of the teachings presented in the foregoing descriptions and the associated drawings.

The described features, structures, or characteristics may be combined in any suitable manner in one or more embodiments. In the above description, numerous specific details are provided for a thorough understanding of embodiments of the invention. One skilled in the relevant art will recognize, however, that embodiments of the invention can be practiced without one or more of the specific details, or with other methods, components, materials, etc. In other instances, well-known structures, materials, or operations may not be shown or described in detail.

While operations are depicted in the drawings in a particular order, this should not be understood as requiring that such operations be performed in the particular order shown or in sequential order, or that all illustrated operations be performed, to achieve desirable results.

The invention claimed is:

1. A garment stretching apparatus comprising:

top attachment device comprising an elongated portion having a first end and a second end, a first hook portion extending from the first end, and a second hook portion extending from the second end wherein the first hook portion forms a first hook on a first side of the elongated portion and the second hook portion forms a second hook on a second, opposite side of the elongated portion wherein the first hook concaves downwardly and the second hook concaves upwardly when the elongated portion extends vertically;

a bottom attachment device comprising an elongated portion having a first end and a second end, a first hook portion extending from the second end, and a second hook portion extending from the first end wherein the first hook portion forms a first hook on a first side of the elongated portion and the second hook portion forms a second hook on a second, opposite side of the elongated portion wherein the first hook concaves upwardly and the second hook concaves downwardly when the elongated portion extends vertically;

an adjustable strap comprising a first strap having a first end and a second end, a second strap having a first end and a second end, and a third strap having a first end and a second end, the adjustable strap further comprising a first buckle and a second buckle wherein a closed loop is attached to the first end of the first strap, the second end of the first strap is attached to a first side of the first buckle, the first end of the second strap extends through the second side of the first buckle wherein the first strap, the second strap, and the first buckle are configured such that the first buckle adjusts the second strap, wherein the second strap extends through a first side of the second buckle, the third strap is attached to a second side of the second buckle, wherein the third strap comprises an opening through the third strap wherein the second strap, the third strap, and the second buckle are configured such that the second buckle moves along the second strap, a closed loop is attached to the second end of the first strap;

a first hanger comprising a first hook and a first pair of flats configured to hold a first portion of a garment wherein the first hanger is positioned such that the first hook is above the first pair of flats; and a second hanger comprising a second hook and a second pair of flats configured to hold a second portion of the garment, wherein the first hanger is positioned above the second hanger; and wherein the second hanger is positioned such that the second hook is below the second pair of flats thereby allowing a garment attached to the first pair of flats and the second pair of flats to extend from the first pair of flats to the second pair of flats.

2. A garment stretching apparatus as in claim 1 wherein the first strap comprises one or more openings through the strap.

3. A method of stretching a garment using the garment stretching apparatus of claim 1, the method comprising:

placing the first hook of the top attachment device on top of a door such that a portion of the first hook rest on top of the door and sides of the first hook are configured to extend downwardly on both sides, respectively, of the door;

attaching the closed loop of the first end of the first strap to the second hook of the top attachment device;

placing the bottom attachment device under a bottom of the door such that a portion of the first hook of the bottom attachment device rest under the bottom of the door and the sides of the first hook of the bottom attachment device are configured to extend upwardly on both, respectively, of the door;

attaching the closed loop on the second end of the second strap to the second hook of the bottom attachment device such that the adjustable strap extends vertically from the top attachment device to the bottom attachment device;

securing a first portion of a garment between the first pair of flats;

attaching the first hook of the first hanger to the garment stretching apparatus at a first position whereby the first hook is above the first pair of flats;

securing a second portion of the garment between the second pair of flats; and attaching and orientating the second hook of the second hanger to the garment stretching apparatus at a second position whereby the first position is higher than the second position and whereby the second hook is below the second pair of flats thereby allowing the garment attached to the first pair of flats and the second pair of flats to extend vertically from the first pair of flats to the second pair of flats.

4. A method of claim 3 wherein the first hook of the first hanger is attached to the garment stretching apparatus by placing the first hook of the first hanger on the second hook of the top attachment device.

5. A method of claim 3 wherein the first hook of the first hanger is attached to the garment stretching apparatus by inserting the first hook of the first hanger into an opening of the first strap.

6. The method of claim 3 wherein the second hook of the second hanger is attached to the garment stretching apparatus by inserting the second hook of the second hanger into an opening of the third strap.

* * * * *